US005200005A

United States Patent [19]

Najah-Zadeh et al.

[11] Patent Number: 5,200,005

[45] Date of Patent: Apr. 6, 1993

[54] INTERSTITIAL FREE STEELS AND METHOD THEREOF

[75] Inventors: Abbas Najah-Zadeh, Montreal; John J. Jonas, Westmount; Stephen Yue, Montreal, all of Canada

[73] Assignee: McGill University, Montreal

[21] Appl. No.: 652,872

[22] Filed: Feb. 8, 1991

[51] Int. Cl.[5] ..... C21D 7/13

[52] U.S. Cl. ..... 148/648; 148/320; 72/365.2

[58] Field of Search ..... 72/199, 365.2, 366.2, 72/202; 148/12 R, 320, 648

[56] References Cited

U.S. PATENT DOCUMENTS 3,755,004 8/1973 Miller ..... 148/12.4
4,466,842 8/1984 Yada et al. ..... 148/12 R
4,720,307 1/1988 Matsumoto et al. ..... 148/12 R

FOREIGN PATENT DOCUMENTS 55-10648 3/1980 Japan ..... 72/365.2

*Primary Examiner*—Deborah Yee
*Attorney, Agent, or Firm*—Bachman & LaPointe

[57] ABSTRACT

The strength of interstitial free steels is increased by up to 100% and the ductile to brittle transition temperature is decreased by up to 100° C. by warm finish rolling in the single phase ferrite region below $A_{r1}$ to effect ferrite dynamic recrystallization of the steel microstructure to a ferrite structure of grain size having a grain size of up to 5 μm, and especially an ultra fine grain size of 1 to 2 μm; the method may be employed in various hot working methods including strip and rod mills, planetary hot rolling and extrusion.

21 Claims, 12 Drawing Sheets

INTERSTITIAL FREE STEELS AND METHOD THEREOF

BACKGROUND OF THE INVENTION i) Field of the Invention

This invention relates to a method of processing an interstitial free steel to increase strength and toughness of the steel; and to an interstitial free steel having an average grain size of up to 5 μm, in particular ultra-fine grain sizes of 1 to 2 μm, in particular such steels exhibit superior strength and toughness.

ii) Description of Prior Art

In steel, a high level of cold formability can be attained by reducing the concentration of interstitial elements, i.e, C and N, to a low level. Removal of these elements from the matrix is performed largely by vacuum degassing techniques. The resulting low interstitial concentration can be further reduced by the addition of Ti and/or Nb, which combine with C and N, leading to a solute level of these elements of only a few parts per million. These steels are known as interstitial free, or IF steels, and are, at present, mainly used in deep drawing applications.

It is well known that in polycrystalline metals grain size exhibits a strong effect on the mechanical properties; the finer the grain size the greater the strength or hardness, and the higher the toughness. Many attempts have been made to refine the ferrite grain size, because this is the only microstructural characteristic which can simultaneously improve both the yield strength and the toughness.

Yada et al. in U.S. Pat. No. 4,466,842 describe a technique for producing ultrafine grained ferrite in conventional C-Mn steels. According to their method, ultrafine grained ferrite is produced when such steels are rolled in the intercritical region, i.e., the austenite-plus-ferrite region, a two phase region between the single phase austenitic region and the single phase ferrite region. Yada et al. attribute this grain size refinement to the dynamic transformation of austenite to ferrite, as well as to the dynamic recrystallization of ferrite. It is probable that the former mechanism dominates, in which ultrafine grained ferrite is produced as a result of the repeated nucleation of ferrite at grain boundaries, with the dynamic recrystallization of ferrite playing only a minor role. Furthermore, Yada et al. specify that the dynamic recrystallization of ferrite only takes place in the intercritical region.

SUMMARY OF THE INVENTION

It is an object of this invention to provide a method of processing an interstitial free steel to increase the strength and toughness of the steel.

It is a further object of the invention to provide an interstitial free steel having a ferrite grain size of up to 5 μm and which displays superior strength and toughness.

It is a particular object of the invention to provide an interstitial free steel having an ultrafine ferrite grain size of less than 2 μm.

In accordance with one aspect of the invention there is provided a method of processing an interstitial free steel to increase strength and toughness of the steel comprising warm finish rolling an interstitial free steel in the single phase ferrite region below $A_{rl}$ to effect ferrite dynamic recrystallization of the steel microstructure to a ferrite structure of an average grain size of at most 5 μm.

In accordance with another aspect of the invention there is provided an interstitial free steel of increased strength and toughness produced by warm rolling an interstitial free steel at a temperature below $A_{rl}$ in the single phase ferrite region to effect ferrite dynamic recrystallization of the steel microstructure to a ferrite structure of an average grain size of at most 5 μm, more especially an ultrafine grain size of less than 2 μm.

The method of the invention particularly contemplates subjecting the steel to a rolling schedule comprising a plurality of roughing rolling processes followed by a plurality of finishing rolling passes.

In a first method of the invention the roughing rolling passes are carried out in the single phase austenite region above $A_{r3}$ and the finishing rolling passes are carried out in the single phase ferrite region below $A_{rl}$.

In a second method within the scope of the invention both the roughing rolling passes and the finishing rolling passes are carried out in the single phase ferrite region below $A_{rl}$.

In the context of the present invention interstitial free steels are to be understood as steels having a carbon content in wt. % of less than 0.01% and a nitrogen content in wt. % of less than 0.01%.

In the context of the present invention an ultrafine grain size means average grain sizes of about 1 to 2 μm; and fine grain size means average grain sizes of about 3 to 5 μm.

In accordance with the invention the grain size of at most 5 μm in IF steels results in an increase in strength of 25 to 100%; and the ductile to brittle transition temperature is decreased by up to 100° C., as compared with conventional steels which have a grain size of more than 10 μm.

BRIEF DESCRIPTION OF DRAWINGS

The invention is further explained by reference to the accompanying drawings in which.

DESCRIPTION OF PREFERRED EMBODIMENTS

Figure 1:
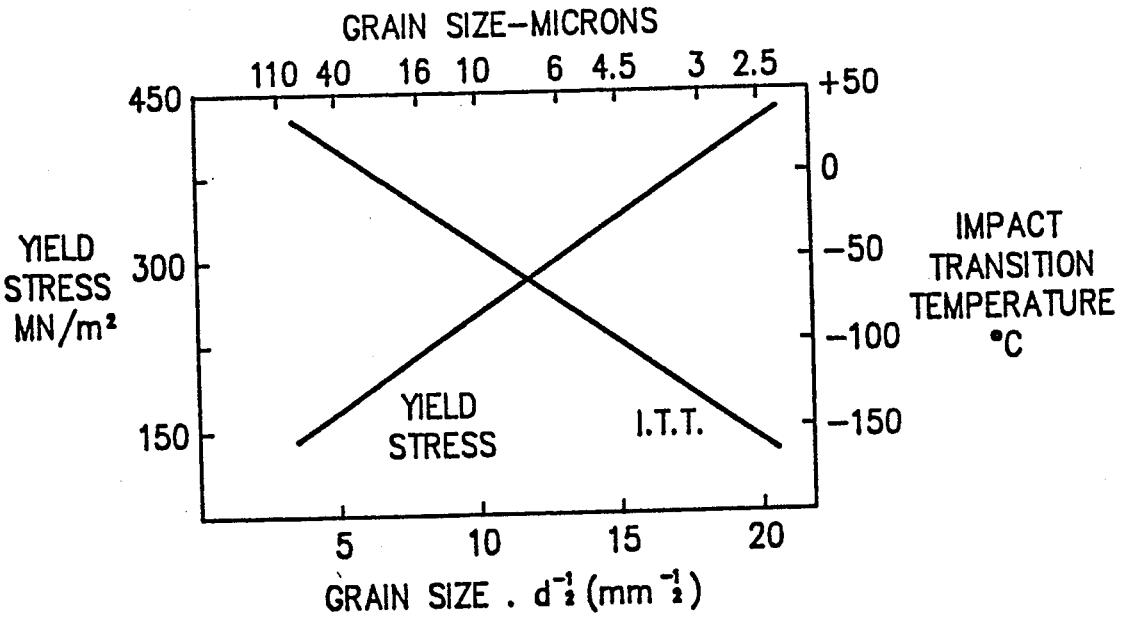
FIG. 1 illustrates the effect of the grain size of ferrite on the yield strength, and the toughness or impact transition temperature, FIG. 2 demonstrates the dependence of the mean flow stress on the inverse absolute temperature for interstitial free steels (IF) and high strength low alloy steels (HSLA)

In the processing method of the invention interstitial free steels are subjected to a strip rolling schedule comprising a plurality of roughing rolling passes followed by a plurality of finishing rolling passes. The rollings are carried out at elevated temperatures but the steel is allowed to cool during the successive rollings such that the rollings are carried out at successively lower temperatures. Thus the rolling temperatures decrease with successive rollings from a first roughing rolling pass to a final roughing rolling pass and then from a first finishing rolling pass to a final finishing rolling pass. Thus the rolling temperature of the first finishing rolling pass is lower than the rolling temperature of the final roughing rolling pass.

In a typical strip rolling schedule there may be up to 9, usually about 7 roughing rolling passes followed by up to 8, usually about 5 or 6, finishing rolling passes.

The rollings are carried out to achieve ferrite dynamic recrystallization of the steel microstructure and this requires appropriate control of the temperature of rolling, the interpass time between successive rollings, but also is dependent on the interstitial content of carbon and nitrogen in the steel. It is found for interpass times typical in conventional strip rolling that dynamic recrystallization of ferrite in IF steels occurs by rolling at temperatures well below the $A_{rl}$ to eliminate conventional static recrystallization in the interpass intervals and in this way permitting the accumulation of strain that leads to the initiation of dynamic recrystallization.

Ferrite dynamic recrystallization occurs when the steel is subjected to load as in a rolling pass. During application of the load during a rolling pass the crystals are plastically deformed to a more flattened form, and then recrystallize with small grain size while still under load; in this way the ferrite dynamic recrystallization occurs while the steel is under load during rolling. Static recrystallization occurs at elevated temperatures after the removal of load. It is a characteristic of the ferrite microstructure that it does not readily recrystallize statically at temperatures well below $A_{rl}$ and typically will require more than 10 seconds.

In the method of the invention at least the finishing rolling passes are warm rolling passes in the single phase ferrite region of the steel or in other words are carried out below $A_{rl}$, the temperature below which the transformation of the austenite microstructure of the steel to the ferrite microstructure has been completed.

In a first method of the invention the roughing rolling passes are carried out in the single phase austenite region well above $A_{r3}$, the temperature below which transformation of the austenite microstructure of the steel to ferrite commences during cooling.

In the first method the roughing rolling passes are suitably carried out at a temperature in the range of 1280° C. to 1050° C., preferably 1250° C. to 1100° C. The finishing rolling passes are suitably carried out at a temperature in the range of $A_{rl}$ to 275 below $A_{rl}$, preferably 750° C. to 600° C. and more preferably 700° C. to 650° C., with a delay time between successive passes of 3.5 to 0.5 or less seconds. In order to obtain an ultrafine ferrite grain size the temperature of the finishing rolling passes should be at least 150° C. below $A_{rl}$. In particular it is preferred that the final finishing passes be at delay times of less than 2 seconds.

In the second method the roughing rolling passes are suitably carried out at a temperature in the range of $A_{rl}$ to 50° C. below $A_{rl}$. The finishing rolling passes are suitably carried out at a temperature in the range of $A_{rl}$ to 275 below $A_{rl}$, preferably 750° C. to 600° C. and more preferably 700° C. to 650° C. with a delay time between successive passes of 3.5 to 0.5 or less seconds, and it is preferred that the final finishing passes be at delay times of less than 2 seconds. It is especially preferred that the finishing rolling passes be at temperatures below the roughing rolling passes.

In the method of the invention at least the finishing rolling passes are warm rolling passes in the single phase ferrite region of the IF steels, or in other words are carried out below $A_{rl}$, the temperature below which the transformation of austenite to ferrite microstructure of the steel on cooling is completed.

In a second method of the invention both the roughing and finishing rolling passes are warm rolling passes carried out in the single phase ferrite region below $A_{rl}$ of the IF steel.

No rolling passes are carried out in the intercritical two phase region between $A_{rl}$ and $A_{r3}$ which is a region containing both ferrite and austenite.

Usually about 50% of the total deformation in a strip rolling sequence is achieved in the rough rolling passes. The finish rolling passes are normally carried out with different rolls which are usually harder because the finish rolling passes are carried out at lower temperatures at which the resistance to working is greater.

Suitably the strain per pass in the finishing rolling is greater than 0.4, preferably greater than 0.5 strain per pass to achieve ferrite dynamic recrystallization.

FIG. 1 of the drawings is a plot taken from F. B. Pickering, Physical Metallurgy and Design of Steels, p. 16, Applied Science Publishing Ltd., 1978, U.K. which shows the effect of ferrite grain size on yield tress and toughness (impact transition temperature) in steel, and Table 1 below demonstrates the effect which reduction of ferrite grain size has on the yield strength and impact transition temperature of IF steels.

TABLE 1

Estimated effect of reducing the ferrite grain size on the yield strength and impact transition temperature of IF steels

| Ferrite grain size (μm) | Yield strength (MPa) | Impact transition temp. (°C.) |
|---|---|---|
| 8 | 210 | −40 |

TABLE 1-continued

Estimated effect of reducing the ferrite grain size on the yield strength and impact transition temperature of IF steels

| Ferrite grain size (μm) | Yield strength (MPa) | Impact transition temp. (°C.) |
|---|---|---|
| 6 | 240 | −70 |
| 5 | 260 | −90 |
| 4 | 290 | −100 |
| 3 | 330 | −130 |
| 2 | 400 | −160* |
| 1.5 | 460 | −190* |
| 1 | 560 | −210* |

(*estimated by extrapolation of FIG. 1 data)

TABLE 2

Chemical compositions of the three IF steels (wt pct).

| Steel Code | C | Si | Mn | S | N | Ti | Nb |
|---|---|---|---|---|---|---|---|
| A (~0.06% Ti) | .0035 | .022 | .15 | .012 | .003 | .065 | — |
| B (~0.03% Ti + 0.03% Nb) | .0035 | .024 | .16 | .012 | .003 | .026 | .035 |
| C (~0.06% Nb) | .0036 | .024 | .16 | .012 | .003 | — | .056 |

Table 1 demonstrates that ultrafine ferrite microstructure leads to an increase in strength of up to 100% as compared with fine grain ferrite structures.

Figure 2:
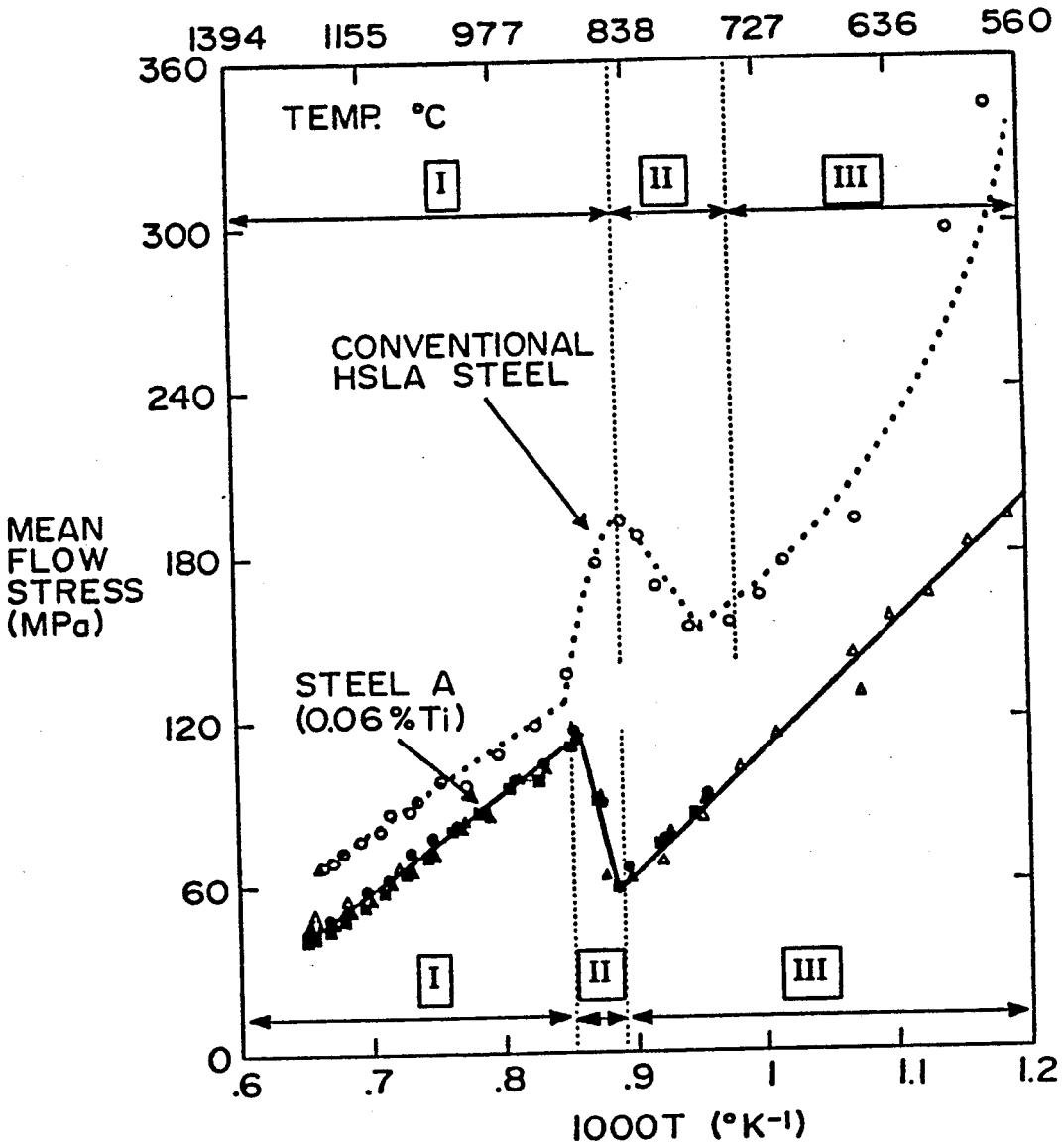

The present invention and the conventional method of hot rolling steel are differentiated in FIG. 2, which illustrates the dependence of the mean flow stress, i.e., the resistance to hot deformation, on the inverse absolute temperature for IF and conventional HSLA steels. This diagram can be used to distinguish between three deformation processing regions (the regions corresponding to the IF and conventional HSLA steels, respectively are shown in the lower and upper parts of this diagram). REGION I: is a single phase austenite region where hot rolling conventionally takes place. For this type of processing, all rolling passes are executed at temperatures above $A_{r3}$, the temperature below which the transformation of austenite-to-ferrite begins. REGION II: corresponds to rolling in the intercritical region, a two phase region of austenite and ferrite. Such processing is not used in IF steels because the temperature range is too narrow and the rate of mean flow stress change is rapid, both effects leading to process control difficulties. The difference between the $A_{r3}$ and $A_{rl}$ (the temperature below which the microstructure has completely transformed to ferrite) is considerably greater in steels of conventional interstitial levels and thus rolling in REGION II can be used in such conventional steels. REGION III: is rolling at elevated temperatures in the single phase ferrite region, and is usually referred to as warm rolling. In conventional steels, decreasing the temperature into REGION III increases the mean flow stress rapidly and hence the rolling load. Thus, warm rolling can only be employed in conventional steels for two, three or four passes and under special conditions. However, it has been found that IF steels can be processed extensively in this region, in which there are appreciably lower flow stresses displayed by the IF steels. The mean flow stresses typical of IF and HSLA steels are compared in FIG. 2.

In an industrial scenario, in order to accommodate the higher roughing temperature of the first method of the invention (Method 1) a longer delay time between roughing and finishing is necessary. This longer delay time allows the temperature of the steel to decrease below the $A_{rl}$ to enable finish rolling to be performed in the single phase ferrite region.

Examples of the two methods in accordance with the invention were carried out with the IF steels of Table 2 and strip rolling schedules set out in Table 3, in which the equivalent strain is determined from:

$$\epsilon eq = 1.15 \ ln \ (H_{in}/H_{out})$$

wherein $\epsilon eq$ = equivalent strain $H_{in}$ = height (thickness) before rolling pass $H_{out}$ = height (thickness) after rolling pass.

Other formulae apply for other processes, for example, rod rolling.

TABLE 3

Simulated strip rolling schedules used in the present work. The strain rate was $2s^{-1}$ for each pass.

| Pass # | Equivalent strain per pass | Delay time between passes, (s) |
|---|---|---|
| R1 | 0.23 | 3.5 |
| R2 | 0.25 | 8 |
| R3 | 0.23 | 10 |
| R4 | 0.29 | 12 |
| R5 | 0.39 | 13 |
| R6 | 0.67 | 18 |
| R7 | 0.55 | 150 or 300 |
| F1 | 0.41 | 3.5 |
| F2 | 0.57 | 2.5 |
| F3 | 0.55 | 1.7 |
| F4 | 0.55 | 0.8 |
| F5 | 0.55 | — |

Figure 3:
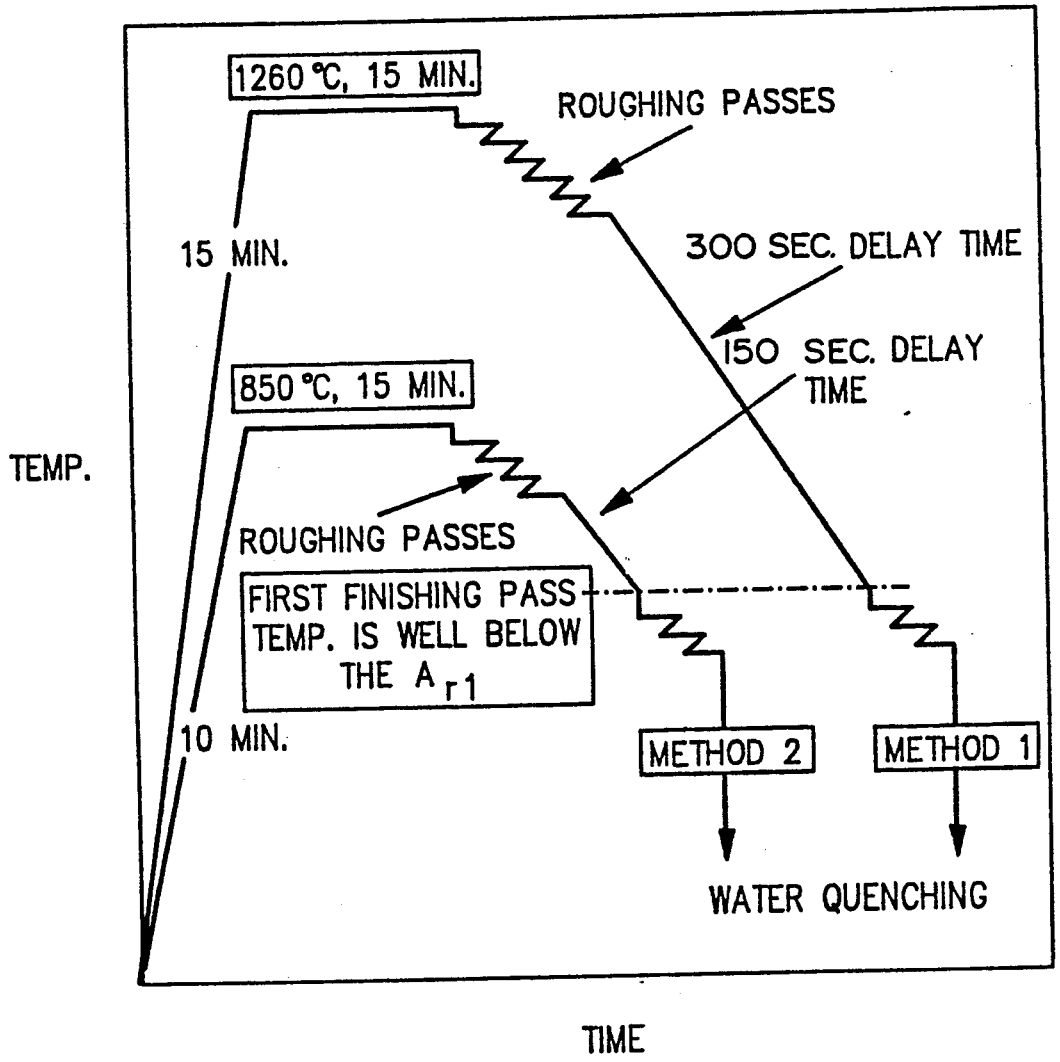
FIG. 3 illustrates diagrammatically the time/temperature schedules for the first and second methods in accordance with the invention.

The two methods are illustrated diagrammatically in FIG. 3.

In the first method, Method 1, the roughing rolling passes ($R_1$ to $R_7$ in Table 3) are carried out in the austenitic region with the first roughing rolling pass ($R_1$ in Table 3) at 1260° C.; and the first finishing rolling pass ($F_1$ in Table 3) at 710° C., which is significantly below the $A_{rl}$ of about 860° C. of these steels.

In the second method, Method 2, the roughing rolling passes ($R_1$ to $R_7$ in Table 3) are carried out in the ferrite region with the first roughing rolling pass ($R_1$ in Table 3) at 850° C., i.e., below the $A_{rl}$ of about 860° C., and the first finishing rolling pass ($F_1$ in Table 3) at 700° C.

The delay time between the final roughing rolling pass ($R_7$ in Table 3) and the first finishing rolling pass ($F_1$ in Table 3) is 300 seconds and is twice the corresponding delay time of 150 second in Method 2.

Example of Processing IF Steels Using Method 1

Figure 4:
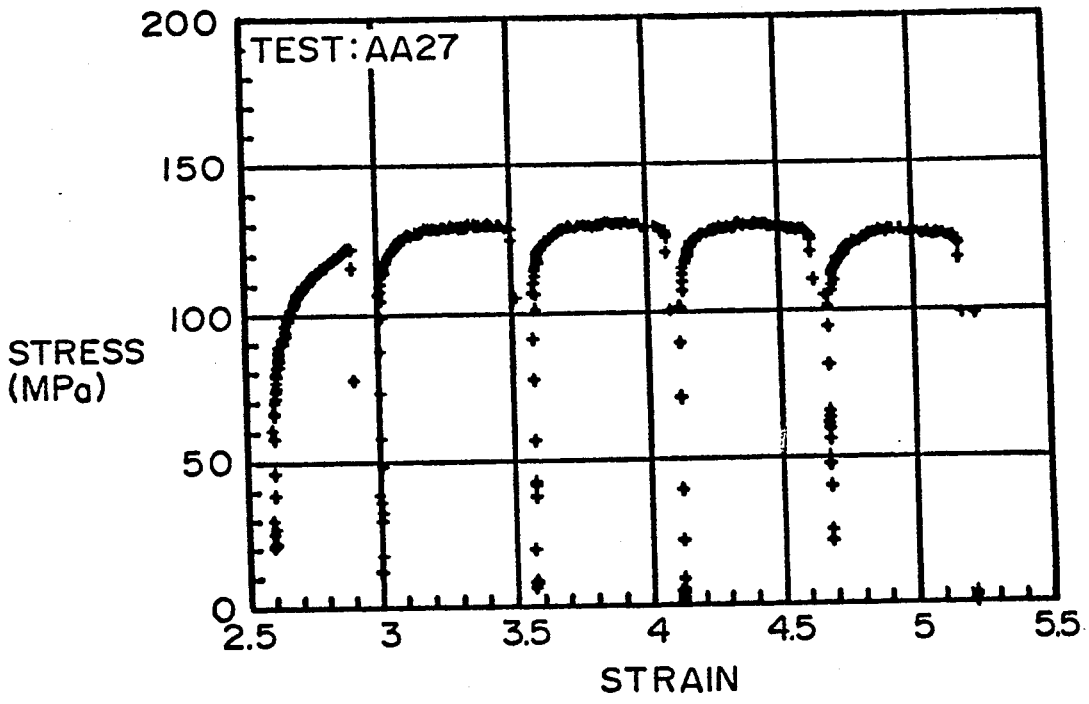
FIG. 4 is a plot of stress-strain curves for IF steel A processed in accordance with the first method of the invention employing a temperature of 710° C. for the first finishing rolling pass.

FIG. 4 illustrates the flow curves associated with the simulated finishing passes ($F_1$ to $F_5$ in Table 3) for an IF steel A of Table 2 containing 0.06% Ti, rolled according to the first strip rolling schedule of Table 3. As can be seen in FIG. 4, there is an accumulation of strain, i.e., work hardening, from the first to the second finishing pass. After that, however, no further increase in flow stress is observed, despite the decreases in temperature associated with the successive finishing passes. This lack of increase in flow stress indicates that dynamic recrystallization is taking place during deformation, leading to a decrease in the isothermal flow stress and offsetting the effect of the decrease in temperature.

Figure 5A:
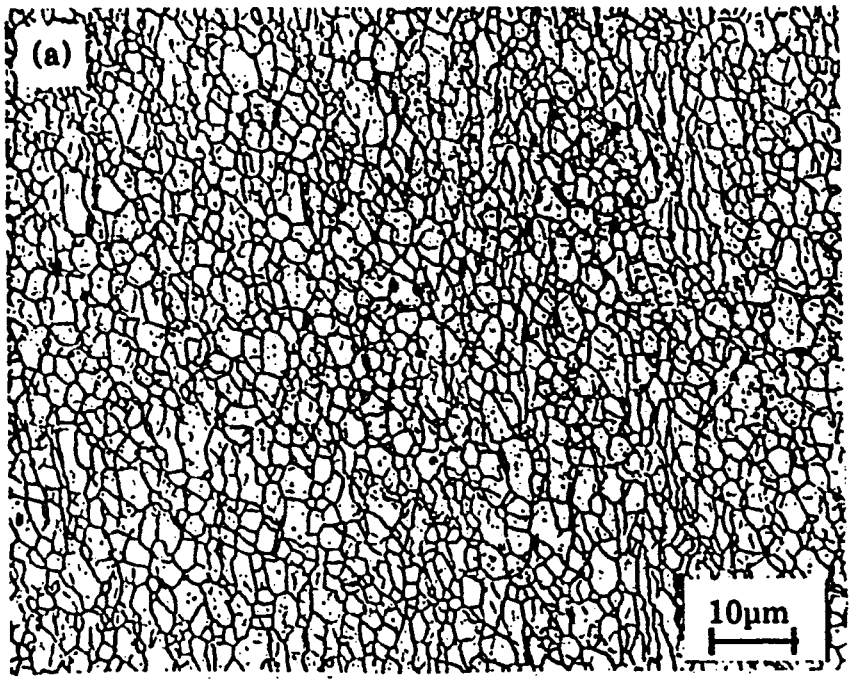
FIG. 5*a* is a microphotograph showing the ultrafine ferrite structure of the IF steel A of FIG. 4.
Figure 5B:
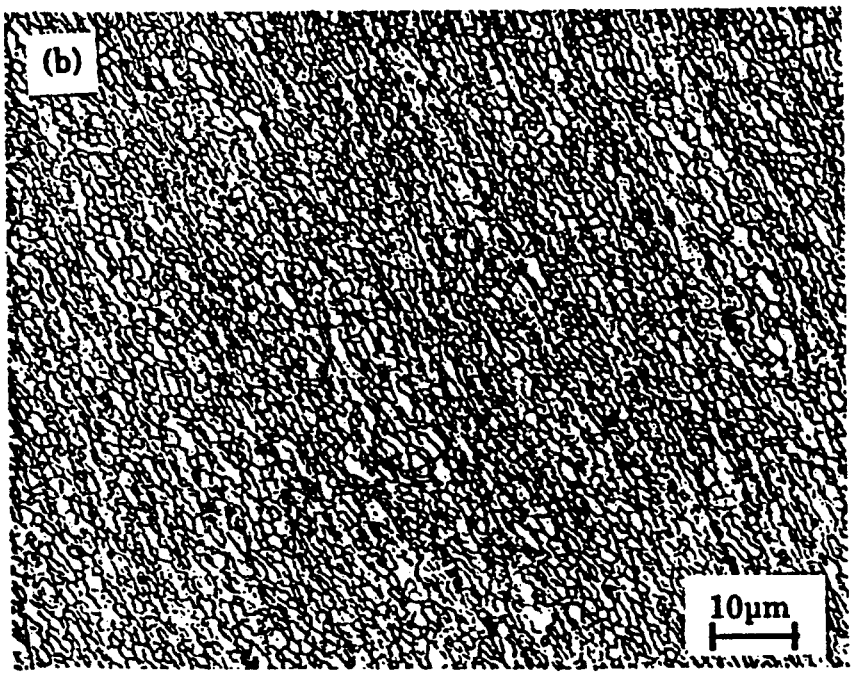
FIG. 5*b* is a microphotograph similar to FIG. 5*a* showing the further reduction in grain size for steel of the same composition as IF steel A achieved by a lowering of the temperature of the first finishing rolling pass to 590° C.
Figure 6:
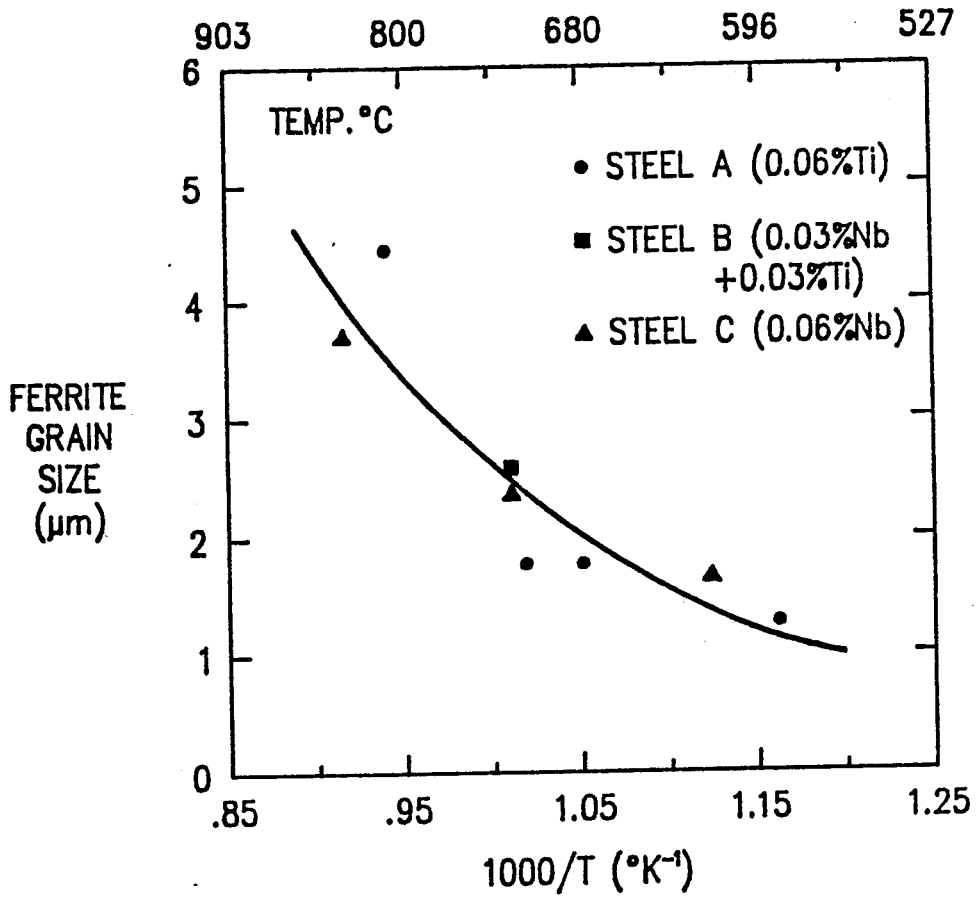
FIG. 6 is a plot showing the dependence of ferrite grain size of IF steels A, B and C, on the inverse absolute temperature of the first finishing rolling pass in the first method of the invention.

The microstructure corresponding to the rolling schedule of FIG. 4 is shown in FIG. 5*a*. It is apparent that dynamic recrystallization of the ferrite produced a rather fine ferrite grain size of 1.8 μm when the first finishing pass temperature $T_{F1}$, was 710° C. When $T_{F1}$ was further lowered to 590° C., the grain size decreased still more to 1.3 μm as shown in FIG. 5*b*. The overall effect of the temperature of the first finishing pass on the ferrite grain size is illustrated in FIG. 6.

Example of Processing IF Steels Using Method 2

Figure 7A:
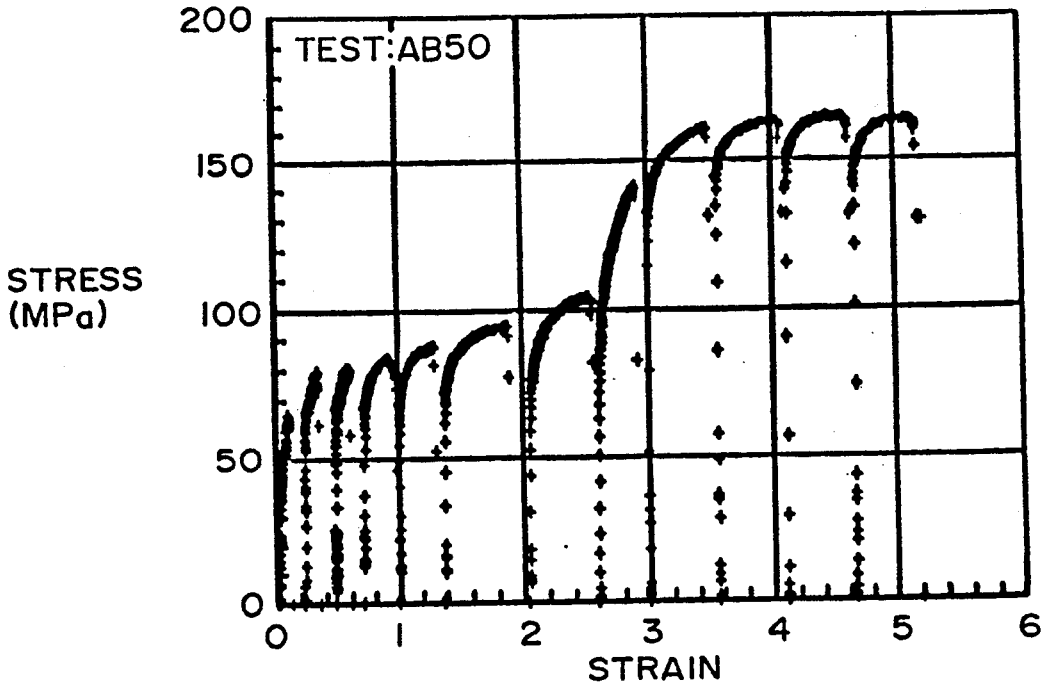
FIG. 7*a* is a plot of stress-strain curves for an IF steel B processed in accordance with the second method of the invention.
Figure 7B:
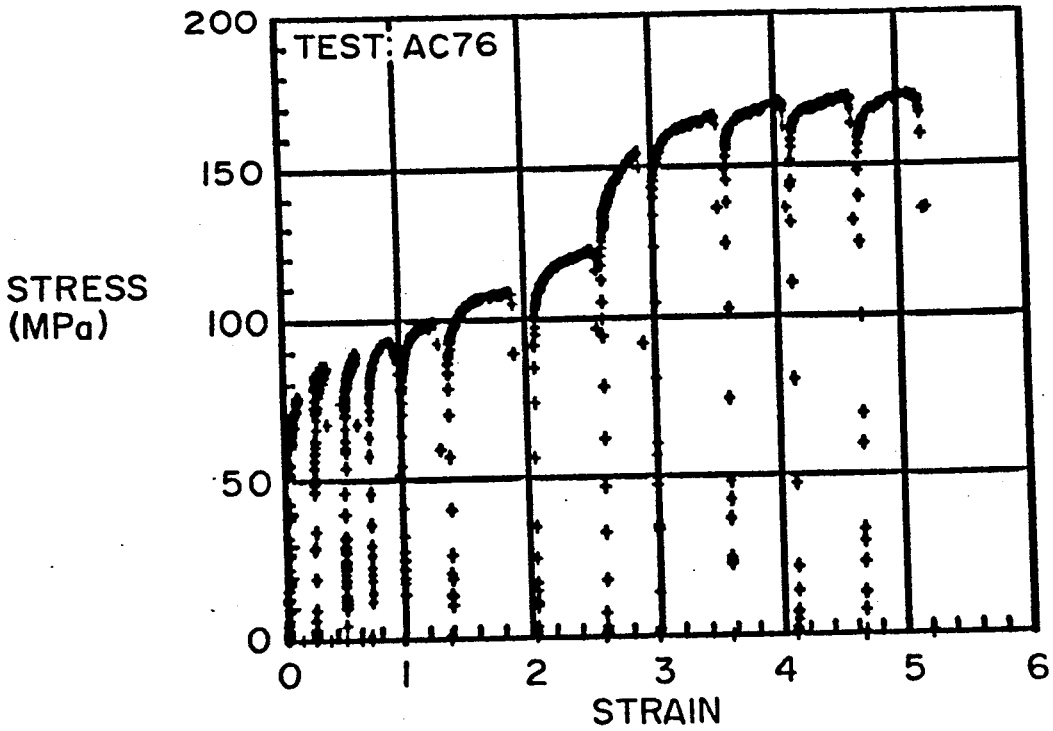
FIG. 7*b* is a plot of stress-strain curves for an IF steel C processed in accordance with the second method of the invention.
Figure 8:
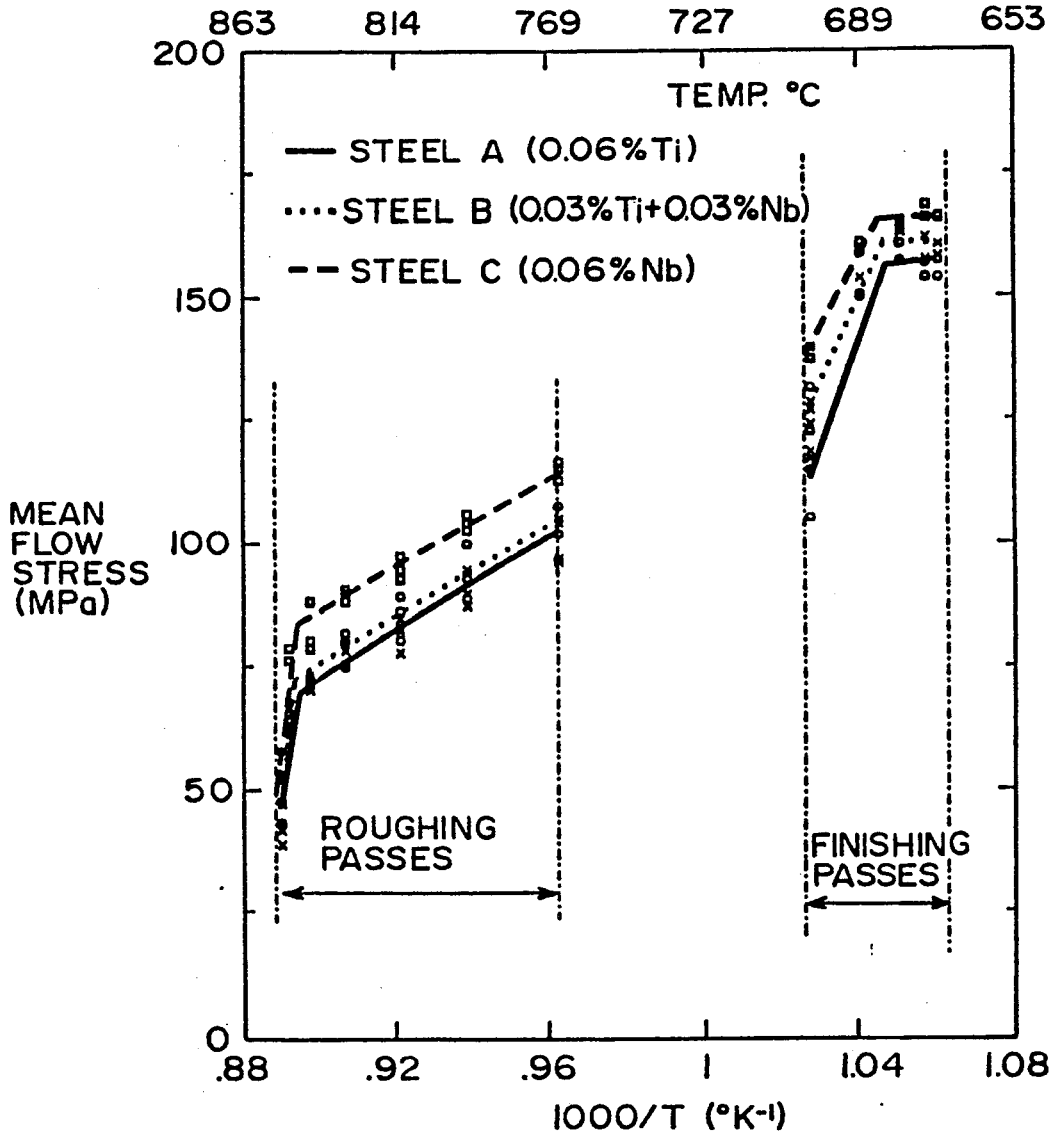
FIG. 8 is a plot of mean flow stress against inverse absolute temperature for IF steels A, B and C processed in accordance with the second method of the invention.
Figure 9:
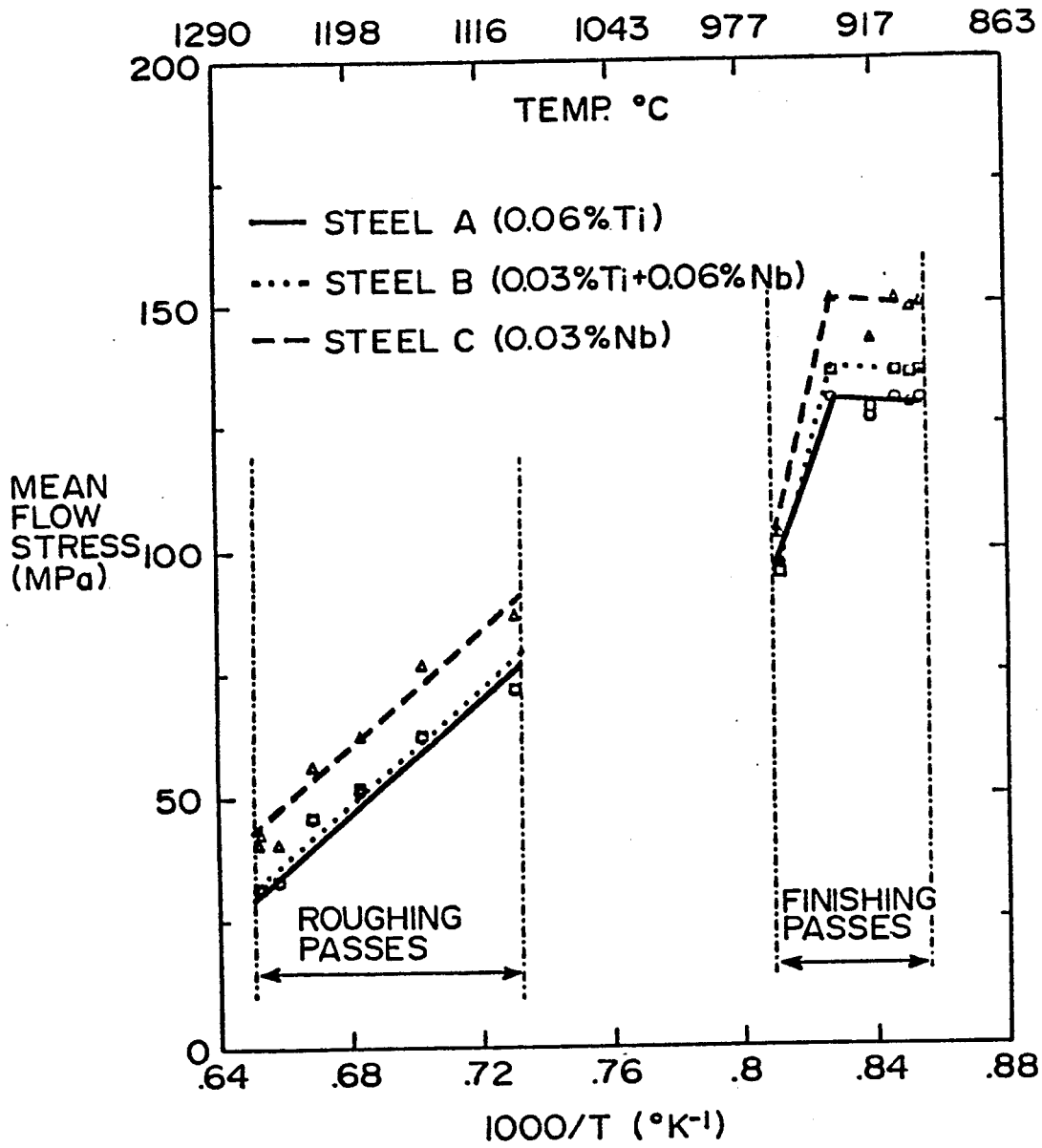
FIG. 9 is a plot corresponding to FIG. 8 for IF steels A, B and C processed under conventional rolling conditions, for comparison purposes with FIG. 8.

FIGS. 7*a* and 7*b* show the flow curves for the two IF steels rolled totally in the ferrite region, where the temperatures of the first roughing and finishing passes are 850° and 700° C., respectively. FIG. 8 illustrates the mean flow stress vs. inverse absolute temperature curves corresponding to the flow curves of FIG. 7. It can be seen that the maximum mean flow stress encountered in roughing is 115 MPa. For comparison, the behaviour of the IF steels under conventional rolling conditions is presented in FIG. 9. Here the temperatures of the first roughing and finishing passes are 1260° and 960 C., respectively, corresponding to hot rolling entirely above the $A_{r3}$. From FIGS. 8 and 9, it can be seen that the maximum mean flow stress achieved in roughing using Method 2 is only approximately 30 MPa greater than that of the conventional schedule. Furthermore, the difference between the maximum mean flow stress levels of the respective finishing schedules is less than 20 MPa. The mean flow stresses calculated for each pass strain and temperature must be corrected for the actual strain rates experienced in the finishing mill using an equation of the form:

$$\sigma = k\epsilon^m$$

Here k is the strength coefficient, which depends on the pass strain, temperature and material, and m is the strain rate sensitivity (~0.08 for IF steels in the finishing passes). The mean flow stress, $\sigma_2$, at a mill strain rate of $\epsilon_2$ can be calculated from the simulation stress, $\sigma_1$, and strain rate, $\epsilon_1$ from the equation:

$$\frac{\sigma_2}{\sigma_1} = \left(\frac{\epsilon_2}{\epsilon_1}\right)^m$$

Using this equation, the difference in mean flow stress during roughing and finishing between Method 2 and conventional strip rolling translate into 36 and 29 MPa, respectively (on the assumption that the maximum strain rates in the last roughing and finishing passes are 21 and 200 $S^{-1}$, respectively). The mean flow stress results therefore indicate that the rolling loads associated with Method 2 are expected to be similar to those of a conventional schedule. From the standpoint of rolling load, this new process can thus be used in existing industrial mills.

Figure 10:
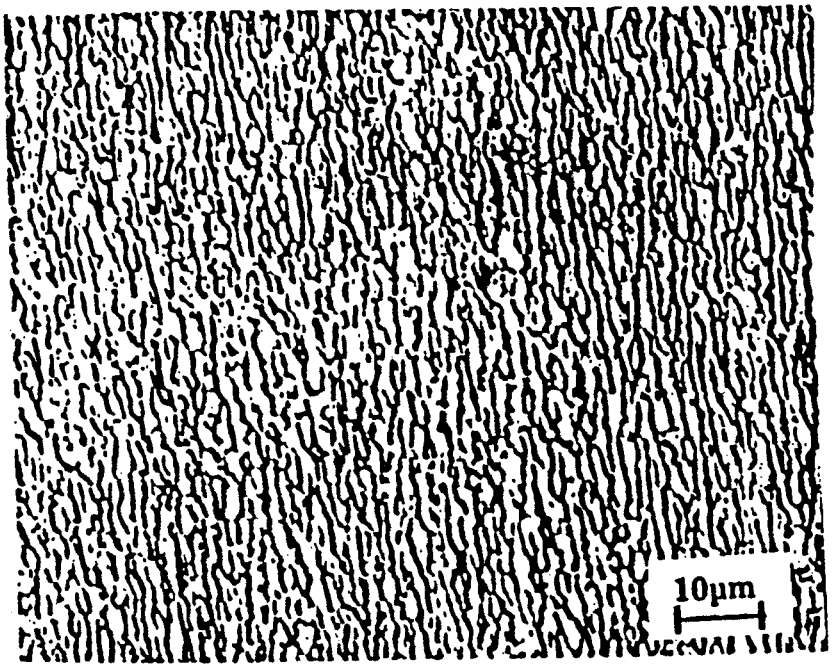
FIG. 10 is a microphotograph showing the ultrafine ferrite grain size of IF steel B processed by the second method of the invention.

An example of the microstructure corresponding to Method 2 is shown in FIG. 10, and reveals an ultrafine ferrite grain size of 1.9 μm.

Figure 11A:
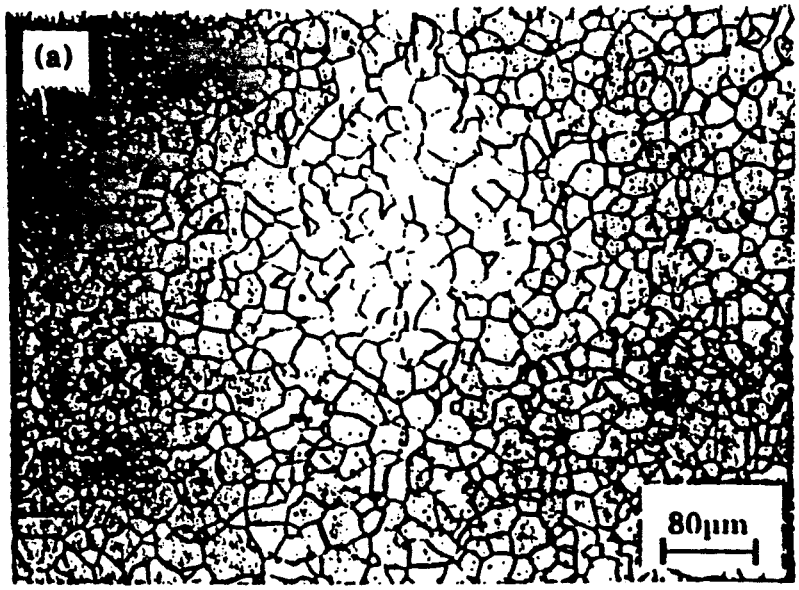
FIGS. 11*a*, 11*b* and 11*c* are microphotographs showing the ferrite grain size of IF steel A processed under different conventional rolling conditions.
Figure 11B:
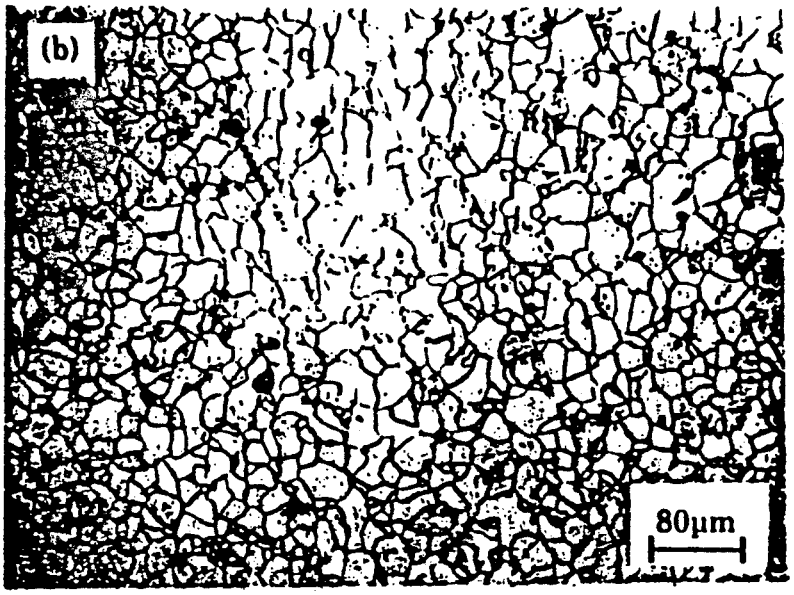
Figure 11C:
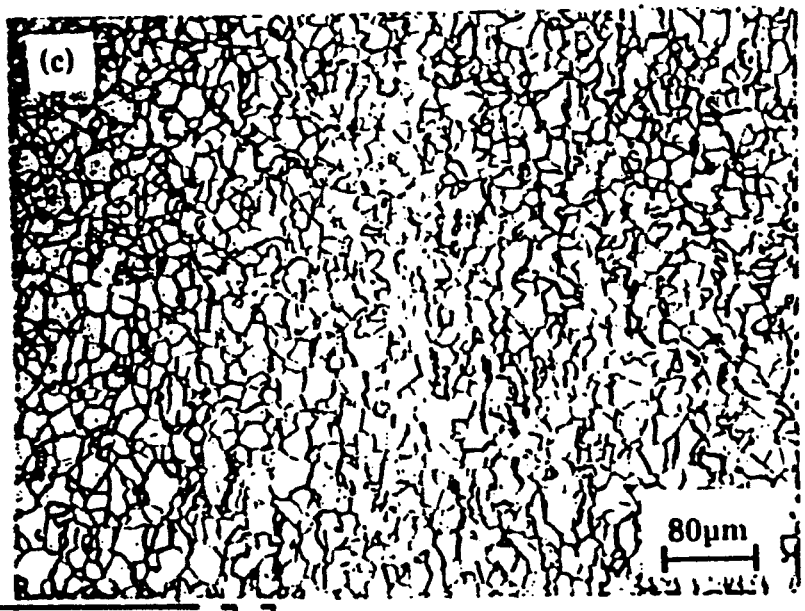
Figure 12:
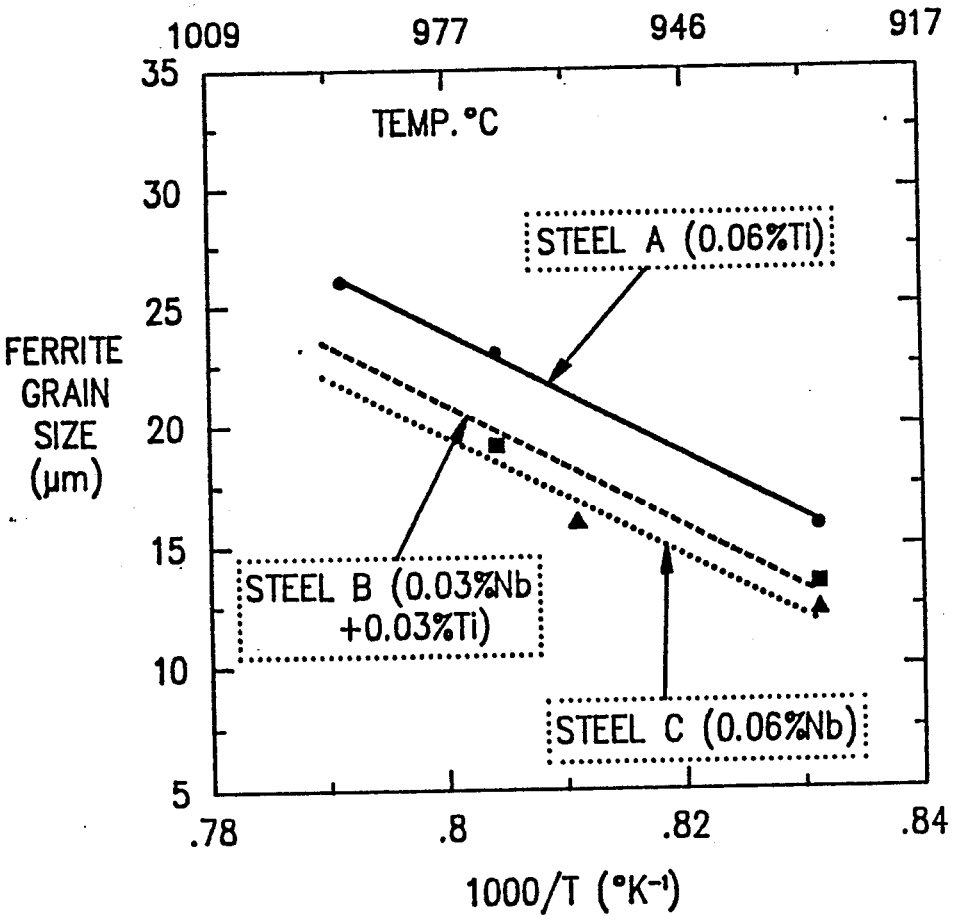
FIG. 12 is a plot showing the dependence of ferrite grain size of IF steels A, B and C on the inverse absolute temperature of the first finishing pass when processed under conventional rolling conditions.

The results of the present invention can be put into perspective by comparing the microstructures produced by the method of the invention (FIGS. 5, 6 and 10) with the grain sizes produced by the conventional rolling process for the IF steel A, i.e., deformation in the austenite region, (FIGS. 11 and 12).

In the IF steel A of FIGS 11*a*, 11*b* and 11*c* the conventional strip rolling schedule employed $R_1$ at 1260° C., a cooling rate of about 20° C./sec. and $\epsilon_f$ (strain during finishing) of 3.2; the first finishing rolling $F_1$ in FIGS. 11*a*, 11*b* and 11*c* was 990°, 970° and 930° C., respectively.

It can be seen that by lowering the temperature F1 from 990° to 930° C. a decrease in the ferrite grain size is achieved and that varying the IF steel composition also has an effect. However, the minimum grain size produced by the conventional rolling method, which occurs in the IF steel grade containing 0.06% Nb, is an order of magnitude greater than that produced by the method of the present invention.

It is also important to note that any ultrafine grain size structure can be destroyed by grain growth. In the present invention, the sensitivity to grain growth is minimized by finishing at low temperatures.

The present invention can be applied to various hot working methods, including strip and rod mills, seamless tube mills, planetary hot rolling and extrusion.

We claim:

1. A method of processing an interstitial free steel to increase strength and toughness of the steel comprising:

warm finish rolling an interstitial free steel in the single phase ferrite region below $A_{rl}$ to effect ferrite dynamic recrystallization of the steel microstructure to a ferrite structure of an average grain size of at most 5 μm.

2. A method of claim 1, wherein said average grain size is 1 to 5 μm diameter.

3. A method of claim 1, wherein said average grain size is 1 to 2 μm.

4. A method of processing an interstitial free steel to increase strength and toughness of the steel comprising:

subjecting an interstitial free steel to a rolling schedule comprising a plurality of roughing rolling passes followed by a plurality of finishing rolling passes, each rolling pass being at an elevated temperature, at least said finishing rolling passes comprising warm rolling at a temperature below $A_{rl}$ in the single phase ferrite region to effect ferrite dynamic recrystallization of the steel microstructure to produce a ferrite structure having a grain size of 1 to 5 μm.

5. A method of claim 4, wherein said ferrite dynamic recrystallization produces a ferrite microstructure of ultrafine grain size.

6. A method of claim 4, wherein said plurality of roughing rolling passes are carried out in said single phase ferrite region below $A_{rl}$.

7. A method of claim 4, wherein said plurality of roughing rolling passes are carried out in the single phase austenite region above $A_{r3}$.

8. A method of claim 7, wherein successive roughing rolling passes of said plurality of roughing rolling passes are at successively lower temperatures from a first roughing rolling pass to a final roughing rolling pass, and successive finishing rolling passes of said plurality of finishing rolling passes are at successively lower temperatures from a first finishing rolling pass to a final finishing rolling pass.

9. A method of claim 8, wherein said rolling schedule includes a time delay between said final roughing rolling pass and said first finishing rolling pass.

10. A method of claim 9, wherein said steel is cooled during said time delay from said austenitic region to said ferrite region.

11. A method of claim 6, wherein successive roughing rolling passes of said plurality of roughing rolling passes are at successively lower temperatures from a first roughing rolling pass to a final roughing rolling pass, and successive finishing rolling passes of said plurality of finishing rolling passes are at successively lower temperature from a first finishing rolling pass to a final finishing rolling pass; said first finishing rolling pass being at a lower temperature than said final roughing rolling pass.

12. A method of claim 11, wherein said rolling schedule includes a time delay between said final roughing rolling pass and said first finishing rolling pass.

13. A method of claim 12, wherein said steel is cooled during said time delay.

14. An interstitial free steel of increased strength and toughness produced by warm finish rolling an interstitial free steel having a content of carbon, said content of carbon being less than 0.01 wt. %, a content of nitrogen, said content of nitrogen being less than 0.01 wt. % and containing at least one of titanium and niobium in a total of about 0.06%, by weight, to react with said carbon and nitrogen, at a temperature below $A_{r1}$ in the single phase ferrite region to effect ferrite dynamic recrystallization of the steel microstructure to a ferrite structure of at most fine grain size of up to 5 μm.

15. A steel of claim 14, wherein said ferrite structure is of ultrafine grain size of 1 to 2 μm.

16. An interstitial free steel of superior strength and toughness characterized by a ferrite structure of at most fine grain size up to 5 μm, said interstitial free steel having a content of carbon, said content of carbon being less than 0.01 wt. %, a content of nitrogen, said content of nitrogen being less than 0.01 wt. % and containing at least one of titanium and niobium in a total of about 0.06%, by weight, to react with said carbon and nitrogen.

17. A steel of claim 16, wherein said grain size is 1 to 5 μm.

18. A steel of claim 17, wherein said grain size is 1 to 2 μm.

19. A steel of claim 25, containing titanium in an amount of about 0.06%, by weight, to react with said carbon and nitrogen.

20. A steel of claim 16, containing niobium in an amount of about 0.06%, by weight, to react with said carbon and nitrogen.

21. A steel of claim 16, containing titanium and niobium in a total amount of about 0.06%, by weight, to react with said carbon and nitrogen.

* * * * *